United States Patent [19]

Saito et al.

[11] Patent Number: 4,457,690

[45] Date of Patent: Jul. 3, 1984

[54] PULSE BURNERS

[75] Inventors: Toshihiko Saito; Fusao Hirasawa, both of Yokohama, Japan

[73] Assignee: Tokyo Shibaura Denki Kabushiki Kaisha, Kawasaki, Japan

[21] Appl. No.: 451,420

[22] Filed: Dec. 20, 1982

[30] Foreign Application Priority Data

Dec. 25, 1981 [JP] Japan ..... 56-193797[U]

[51] Int. Cl.[3] ..... F23C 11/04

[52] U.S. Cl. ..... 431/1

[58] Field of Search ..... 431/1

[56] References Cited

U.S. PATENT DOCUMENTS 2,907,382 10/1959 McIlvaine ..... 431/1

3,005,485 10/1961 Salgo et al. ..... 431/1

FOREIGN PATENT DOCUMENTS 55-102804 8/1980 Japan .

*Primary Examiner*—Carroll B. Dority, Jr.

*Attorney, Agent, or Firm*—Stevens, Davis, Miller & Mosher

[57] ABSTRACT

In a pulse burner of the type wherein an air-fuel mixture in a combustion chamber is explosively burnt by an ignition plug and resulting flame is detected by a flame detector to control the operation of the pulse burner, there is used a flame detector which detects electric current flowing in the flame instead of a thermostat secured to a side wall of the combustion chamber.

6 Claims, 3 Drawing Figures

PULSE BURNERS

BACKGROUND OF THE INVENTION

This invention relates to a pulse burner incorporated into a water heater or air heater utilized in residences, shops or offices of relatively small size.

In prior art combustion systems, such continuous combustion systems as Bunzen type or Gun type have been used in which gas (usually town gas or propane gas) is burnt continuously with a burner disposed at the lower portion, and the combustion gas is sent to a heat exchanger to heat water or air. In this system, in order to increase the heat efficiency it is necessary to increase the heat transfer area of the heat exchanger or to increase the number or density of combustion gas flow passages. This not only increases the sizes of the heater and fan supplying combustion air but also complicates the mechanism.

In recent years, so called pulse burners have been developed and are disclosed in many publications. In principle, the pulse burner resembles a two cycle gasoline engine, in which fuel and air are sucked into a combustion chamber of a relatively small volume, the mixture is caused to explode by an ignition plug and then exhausted through a heat exchanger in the form of a relatively fine pipe. When explosion occurs, the pressure in the combustion chamber increases greatly thereby to close a flapper valve for stopping suction of the air-fuel mixture. Under this condition, the combustion gas is exhausted to the outside of a building via the heat exchanger, thereby creating a negative pressure therein. Then the flapper valve opens automatically to suck again the air-fuel mixture into the combustion chamber. This cycle of operation is repeated at a frequency of 35–80 Hz/sec. The pulse burner has revolutionary advantages over conventional gas or oil burners. More particularly, its heating efficiency is 91 to 96%, meaning saving of fuel and miniaturization of the apparatus, and it does not need a chimney because the combustion product is exhausted at a high speed and high pressure and because the temperature of the exhaust gas is lower than 38° C. Accordingly, an inexpensive plastic pipe (polyvinyl chloride pipe, for example) can be used to extend horizontally to the outdoor through the wall of a building. Without a vertical chimney, heat loss during off cycle is very small. Unexpectedly, the noise cause by frequent explosions is less than 100 dB and can be reduced substantially by suitable means. Moreover, the concentration of the harmful components of the exhaust gas, for example CO, is of the order of less than 0.025% and can be reduced to 0.01–0.005% by volume by suitably selecting the volume of the combustion chamber and the diameter of the exhaust pipe.

A flame detector is installed in the combustion chamber to detect failure of ignition, i.e., explosive combustion of the air-fuel mixture in which case supply of fuel gas and the operation of the ignition plug are stopped and not exploded air-gas mixture in the combustion chamber is purged outside thereof by admitting clean air. Then, the fuel gas is admitted to form a fresh air-gas mixture and the ignition plug is energized to restart the operation. According to this invention, the flame detector detects combustion or flame by sensing electric current flowing through the flame. Such flame detector can be used to control the ignition plug circuit, an electromagnetic valve in a fuel supply conduit and a motor operated fan supplying air into the combustion chamber as disclosed in a copending application filed on the same day and assigned to the same assignee.

Heretofore, combustion or flame in the combustion chamber has been detected by a thermocouple attached to the side wall of the combustion chamber. Where a thermocouple is used to measure the temperature of the combustion chamber or exhaust gas, it often misoperates, so that fresh fuel gas, that is not yet burnt fuel gas is exhausted during pulse combustion because the temperature of the side wall and hence of the thermostat does not decrease at once even when an ignition miss occurs during normal operation.

SUMMARY OF THE INVENTION

It is an object of this invention to provide an improved pulse burner utilizing a novel flame detector that can obviate the disadvantage just mentioned.

According to this invention there is provided a pulse burner comprising a combustion cylinder provided with an ignition plug, a fuel inlet passage for supplying fuel into the combustion cylinder, an air inlet passage for supplying combustion air into the combustion cylinder, flapper valve means operated by pressure variations caused by an explosive combustion of an air-fuel mixture in the combustion cylinder and exhaust of combustion product therefrom, whereby the flapper valve means repeatedly opens and closes the fuel inlet passage and the air inlet passage, flame confining means disposed in the combustion cylinder to confine therein a portion of the combustion product, and a flame detector positioned in the flame confining means for detecting flame in accordance with electric current flowing through the flame.

DESCRIPTION OF THE PREFERRED EMBODIMENTS

Figure 1:
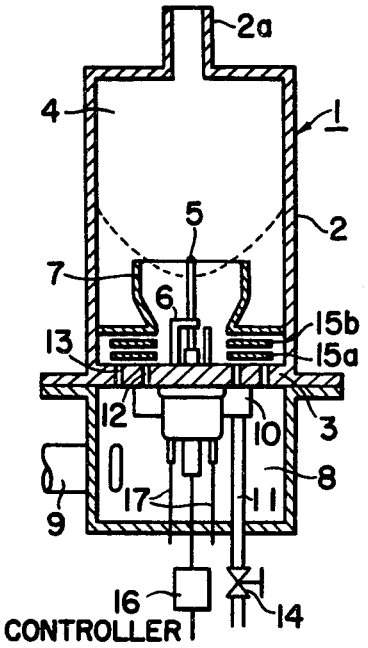
FIG. 1 is a longitudinal sectional view showing a pulse burner embodying the invention.

Referring now to FIG. 1 a pulse burner 1 embodying the invention and adapted to warm water for household use comprises a combustion cylinder 2 with its inside partitioned by a partition wall 3 into an upper combustion chamber 4 and a lower air chamber 8. At the center of the partition wall 3 is secured a vertical flame detector 5 in the form of an elongated rod extending into the combustion chamber 4. An ignition plug 6 is provided adjacent to the flame detector 5, and a cup shaped flame confining device 7 is disposed to surround the flame detector and the ignition plug. The flame produced by the ignition plug 6 propergates upwardly so that the flame detector 5 can positively detect the flame. The combustion product is exhausted through a small diameter exhaust pipe 2*a* which passes through a water heater, not shown. Heat exchange between the exhausted combustion product and water or air can be made by a heat exchanger of a well known construction.

An air inlet pipe 9 connected to a motor operated fan, not shown, opens into the air chamber 8 for supplying thereto combustion air. The air chamber 8 is communicated with the combustion chamber 4 through one or more air passages 13 formed through the partition wall 3. A fuel chamber 10 is secured to the bottom of the partition wall 3, and a fuel conduit 11 extending downwardly from the fuel chamber 10 penetrates through the bottom wall of the combustion cylinder 2 and connected to a source of fuel, not shown, through a valve 14, preferably an electromagnetic valve controlled by an electric signal produced by the flame detector 5.

The fuel chamber 10 is communicated with the combustion chamber 4 through one or more fuel passages 12 perforated through the partition wall 3 to form an air-fuel mixture at the lower portion of the combustion chamber 4. Immediately above the air and fuel passages 13 and 12 is disposed on annular ring shaped flapper valve 15*a*, the upward movement thereof being limited by a stationary stop member 15*b*.

An electric signal detected by the flame detector 5 is supplied to a controller 16 for controlling an ignition circuit 17, fuel valve 14 and the fan.

The pulse burner of this invention operates as follows. Thus, the combustion air is forced into the combustion chamber 4 by the fan through the air chamber 8 and the air passages 13. A predetermined time after admission of the combustion air, the fuel valve 14 is opened to admit fuel gas into the combustion chamber through fuel chamber 10 and fuel passages 12, thus forming an air-fuel mixture in a space between the bottom of the cup shaped flame confining device 7 and the partition wall 3. At the same time, the ignition plug 6 is operated through ignition circuit 17 to cause to burn the air-fuel mixture. The combustion product is exhausted to the water warmer through exhaust pipe 2*a*. As the combustion takes place explosively, the pressure in the combustion chamber momentarily increases to close fuel and air passages 12 and 13 by the flapper valve 15*a*. On the other hand, as the combustion product is exhausted at a high speed, the pressure in the combustion chamber 4 becomes negative to open the flapper valve 15*a* to repeat pulsed combustions. Although most of the combustion product is exhausted from the combustion chamber, a portion thereof returns back into the combustion chamber due to the negative pressure and collected in the bottom portion, particularly in the flame confining device 7 below dotted lines so that the remaining hot combustion product is effective to ignite the air-fuel mixture formed in the next cycle. Accordingly, so long as the succeeding explosions occur normally, it is not necessary to energize the ignition plug. Moreover, by the automatic operation of the flapper valve and the negative pressure created in the combustion chamber, combustion air is admitted into the combustion chamber through a suction port of the motor operated fan even when it is stopped.

According to this invention, since the flame detector 5 extends in the direction of propagation of the flame it can positively detect the flame formed by intermittent explosive combustion.

Figure 2:
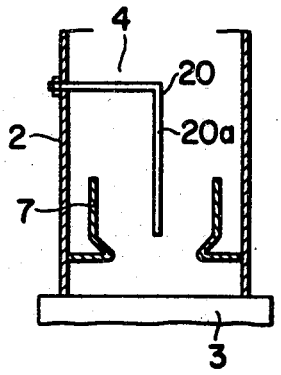
FIG. 2 is a longitudinal sectional view showing a modified flame detector utilized in this invention.

In a modified embodiment shown in FIG. 2, an inverted L shaped flame detector 20 is used having a vertical leg 20*a* positioned at the axial center of the flame confining device 7 and a horizontal leg secured to the combustion cylinder.

Figure 3:
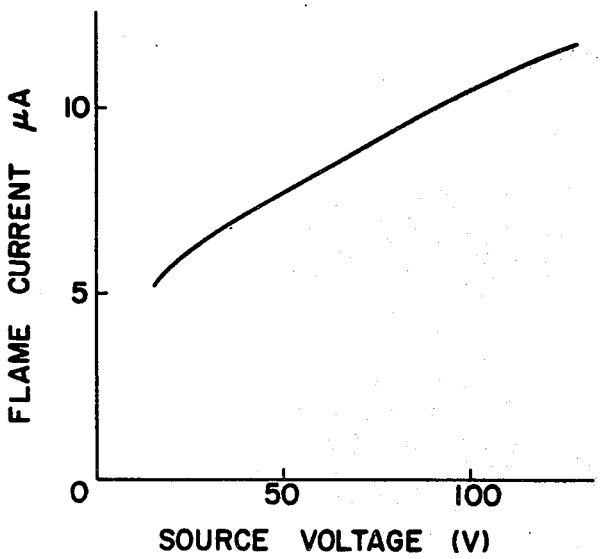
FIG. 3 is a graph showing an operating characteristic of the flame detector utilized in this invention.

FIG. 3 shows an operating characteristic of a flame detector in which the ordinate represents a flame current in microamperes and the abscissa the source voltage in volts. As can be noted from FIG. 3, with a source voltage of 100 V, a flame current of about 10 microamperes can be obtained. With the flame detector of this invention, an elongated rod shaped flame detector detects electric current flowing through the flame between the flame detector and the cup shaped flame confining device so that as the length of the flame detector is increased more current can be detected. Upon failure of an ignition, this flame current does not flow so that the controller 16 closes the fuel valve 14 and restarts the fan to purge not ignited air-fuel mixture. After that, fuel valve 14 is opened and the ignition plug is reenergized to restart a new cycle of explosive combustion. Consequently, different from the prior art pulse burner utilizing a thermostat ignition failure can be detected at once, so that exhausting of not burned fuel can be prevented, thus improving the operating efficiency.

Flame has an electroconductivity and a flame detector can detect presence or absence of flame by detecting current flowing through the flame. However since flame has a rectifier effect or a diode effect it is advantage to impress AC voltage across the flame detector and a grounded portion of the combustion cylinder, for example the combustion cylinder or the flame confining device which come into contact with the flame. If DC voltage is used the flame detector responds leakage current thus resulting in a missoperation.

We claim:

1. A pulse burner comprising:

a combustion cylinder provided with an ignition plug;

a fuel inlet passage for supplying fuel into said combustion cylinder;

an air inlet passage for supplying combustion air into said combustion cylinder;

flapper valve means operated by pressure variations caused by an explosive combustion of an air-fuel mixture in said combustion cylinder and exhaust of combustion product therefrom, whereby the flapper valve means repeatedly opens and closes the fuel inlet passage and the air inlet passage;

flame confining means disposed in said combustion cylinder to confine therein a portion of the combustion product; and a flame detector positioned in said flame confining means for detecting flame in accordance with electric current flowing through said flame.

2. The pulse detector as set forth in claim 1 wherein said combustion cylinder is divided into a combustion chamber and an air chamber by a partition wall provided with said air inlet passage and said fuel inlet passage.

3. The pulse burner as set forth in claim 1 wherein said flame confining means is disposed in said combustion chamber with its bottom spaced from said partition wall and said flapper valve is positioned in a space between the bottom of said flame confining means and said partition wall.

4. The pulse burner as set forth in claim 2 wherein said flame detector is secured to a center of said partition wall to extend along a central axis of said cup shaped flame confining means, and said ignition plug is located near the bottom of said cup shaped flame confining means.

5. The pulse burner as set forth in claim 1 which further comprises a controller supplied with an output signal of said flame detector to controll energization of said ignition plug, and supply of combustion air and fuel into said combustion chamber.

6. The pulse burner as set forth in claim 2 wherein said flame detector has an inverted L shaped configuration, one leg of said detector being secured to said combustion cylinder while the other leg extending along a central axis of said cup shaped flame confining means.

* * * * *